US006508362B2

(12) United States Patent
Hnatow et al.

(10) Patent No.: US 6,508,362 B2
(45) Date of Patent: Jan. 21, 2003

(54) HINGED FLEXIBLE POLYURETHANE FOAM PROTECTIVE PACKAGING AND SHIPPING ELEMENT

(75) Inventors: Michael F. Hnatow, West Chester, PA (US); Vincenzo A. Bonaddio, Boothwyn, PA (US); Chiu Y. Chan, Wilmington, DE (US); Daniel V. Tursi, Media, PA (US); John R. Rucker, Norwood, PA (US)

(73) Assignee: Foamex L.P., Linwood, PA (US)

( * ) Notice: Subject to any disclaimer, the term of this patent is extended or adjusted under 35 U.S.C. 154(b) by 0 days.

(21) Appl. No.: 09/735,563

(22) Filed: Dec. 13, 2000

(65) Prior Publication Data

US 2002/0104772 A1 Aug. 8, 2002

(51) Int. Cl.[7] ..... B65D 81/02
(52) U.S. Cl. ..... 206/523; 206/484; 206/591
(58) Field of Search ..... 206/523, 591, 206/592, 586, 484

(56) References Cited

U.S. PATENT DOCUMENTS

| | | | | | |
|---|---|---|---|---|---|
| 2,252,539 | A | | 8/1941 | Adams | |
| 3,564,811 | A | | 2/1971 | Freeman | |
| 3,695,421 | A | * | 10/1972 | Wood | 206/523 |
| 4,397,705 | A | | 8/1983 | Eckert | |
| 4,784,269 | A | * | 11/1988 | Griffith | 206/453 |
| 4,869,369 | A | | 9/1989 | Turngren | |
| 4,883,179 | A | | 11/1989 | Dionne | |
| 5,024,328 | A | | 6/1991 | Bontrager | |
| 5,160,473 | A | | 11/1992 | Bontrager | |
| 5,226,557 | A | | 7/1993 | Nelson | |
| 5,466,211 | A | * | 11/1995 | Komarek et al. | 156/257 |
| 5,876,813 | A | | 3/1999 | Bambara et al. | |
| 5,882,776 | A | | 3/1999 | Bambara et al. | |
| 5,938,878 | A | | 8/1999 | Hurley et al. | |
| 6,054,005 | A | | 4/2000 | Hurley et al. | |
| 6,082,543 | A | * | 7/2000 | Beliveau | 206/523 |
| 6,167,790 | B1 | | 1/2001 | Bambara et al. | |

* cited by examiner

*Primary Examiner*—Shian Luong
(74) *Attorney, Agent, or Firm*—Connolly Bove Lodge & Hutz LLP

(57) ABSTRACT

A hinged flexible polyurethane foam protective packaging element is formed from a flexible polyurethane foam laminated to a polyethylene, polypropylene or urethane film. The flexible polyurethane foam has a density in the range of 0.7 lbs/ft$^3$ to 2.8 lbs/ft$^3$ and $IFD_{25}$ in the range of 25 lbs to 270 lbs. The film has a thickness from 2 mil to 125 mil. The foam is cut through all or substantially all of its thickness without cutting through a portion of the film. The uncut portion of the film creates a repeatably bendable hinge.

7 Claims, 5 Drawing Sheets

HINGED FLEXIBLE POLYURETHANE FOAM PROTECTIVE PACKAGING AND SHIPPING ELEMENT

BACKGROUND OF THE INVENTION

Fragile articles that are shipped in cartons are often surrounded with protective packaging and shipping elements such as foams, bubble wrap, corrugated cardboard, shredded paper, styrofoam, etc. The packaging and shipping elements are necessary to prevent harm to the fragile article held within the shipping carton. The packaging and shipping elements prevent or minimize movement of the fragile article within the carton and absorb some shocks that occur when the carton is moved or dropped during shipping.

Rigid polyurethane foam has been used in packaging applications where its low cost and ease of application assist packaging designers. Typically for packaging applications, a product with a higher stiffness, as indicated by a higher $IFD_{25}$, or the indentation force to a 25% deflection as measured by ASTM 3574, is desired. Rigid foams generally have such higher $IFD_{25}$. However, due to chemical composition, rigid foams also tend to have poor resiliency. After one impact, the struts in rigid foams are damaged or crushed, do not rebound, and then cannot withstand further impacts.

Flexible foam has also been used in packaging applications, but until recently, such foam has mainly been used in lower load-bearing applications. A good definition for "flexible" foam is that from ASTM 1566: a foam is flexible if a 8"×1"×1" piece of such foam can wrap around a 1" diameter mandrel at room temperature without rupture or fracture. Little work has been done to enhance the packaging design using flexible foams. In many applications where a three-dimensional package is desired, individual flexible foam pieces are cut from sheets and glued together to form the required supporting packaging structure. This adds labor and time to the fabrication.

Hinged packaging frames have been formed from rigid polyethylene foam, styrofoam, corrugated cardboard and polyurethane foam. U.S. Pat. No. 5,024,328 shows a foam packing frame and blank wherein a block or sheet of foam is hot wire or die cut to form a series of notches and curves, and then is pulled apart and folded at the notches and curves to form a packaging frame. When this cutting technique is used to form a packaging frame with flexible polyurethane foam, the notched portions lack stability and tend to twist and tear, making the packaging frame difficult to install in place within the carton or around a fragile article.

Sealed Air Corporation produces STRATOCELL foam laminates for packaging applications. The laminates are formed from a sheet of rigid polyethylene foam onto which is laminated a thin polyethylene film. The rigid foam sheet is cut with a blade, but the film is not cut. The cut portion forms a notch and the uncut film forms a bendable or foldable hinge. The laminate sheet may be stored flat. The notch and hinge are bent to desired shape when the laminate is installed into a shipping carton. The rigid polyethylene foam and hinge have greater durability during installation, but lack the softness, resiliency and shock absorption required for some shipping applications. Rigid foams have a very high compressive strength, which makes it impractical to measure $IFD_{25}$. However, if it were measurable, $IFD_{25}$ for rigid foams is estimated to be well above 300 lb.

U.S. Pat. No. 5,226,557 discloses as one example a protective packaging in which alternating strips of flexible urethane foam and rigid urethane foam are adhered to a film or corrugated paper backing. The strips are joined together to form a panel. The panel is cut to form V-grooves, but the film or corrugated paper backing is not cut and forms a fold edge or hinge. The '557 patent emphasizes the importance of combining flexible and rigid materials together to form the protective packing wrap. The strength and rigidity of the rigid material strips are deemed essential for shipping protection and for strength when stacking the cartons.

Other hinged packaging elements that use rigid plastics and rigid foams are shown in U.S. Pat. Nos. 4,869,369; 4,883,179; 4,397,705; and 3,564,811.

One object of the present invention is to form a flexible polyurethane foam packaging element that can be cut or notched to form a hinge so that it can be folded or bent when placed around a fragile article to protect the article within a shipping carton. A second object is to overcome the drawbacks, such as twisting and tearing and lack of stability, associated with prior flexible polyurethane foam shipping elements.

SUMMARY OF THE INVENTION

A hinged flexible polyurethane foam packaging and shipping element is formed from a flexible polyurethane foam sheet having a desired thickness and an outer surface to which is adhered or laminated to a polyethylene, polypropylene or urethane film. The flexible polyurethane foam has a density in the range of about 0.7 lbs/ft$^3$ to about 2.8 lbs/ft$^3$ and an $IFD_{25}$ in the range of about 25 lbs to about 270 lbs. The film has a thickness from about 2 mil to about 125 mil, preferably from about 2.5 mil to about 5 mil. Where the film itself is also foamed, a greater thickness may be used. The foam is cut, such as by the "kiss-cut" die cutting technique, through all or substantially all of its thickness. At least a portion of the film is not cut. That uncut film portion forms the repeatably bendable hinge. The cut surfaces of the foam may be separated from one another, which causes a bending at the hinge.

The hinged flexible polyurethane foam packaging and shipping element has advantages over the prior art. The element may be stored flat and the hinge portion or portions bent only when the element is being installed within a shipping carton. The hinges eliminate the need to glue foam sheets together to form a three-dimensional design. The flexible polyurethane foam has desired resiliency for protecting fragile articles. Drop curves, which characterize dynamic shock cushioning characteristics ("energy absorption") of materials, show no adverse effects from laminating the foam with a film to form a hinge. The drop curves compare favorably to curves for hinged rigid foam packaging and shipping elements of the prior art, but can be used for packaging applications where resiliency and dynamic cushioning are essential.

In addition, the laminated film offers improved rigidity and stability at the hinged portions, as well as across the entire surface of the element.

DESCRIPTION OF THE PREFERRED EMBODIMENT

Referring first to FIGS. 1–4, the hinged flexible polyurethane foam protective packing and shipping element 10 is shown in its flat or unbent state. A sheet of flexible polyurethane foam 12 having a defined thickness T has a film 14 adhered to its planar top surface. The foam sheet 12 has been cut to a desired shape for a packing element.

Figure 2:
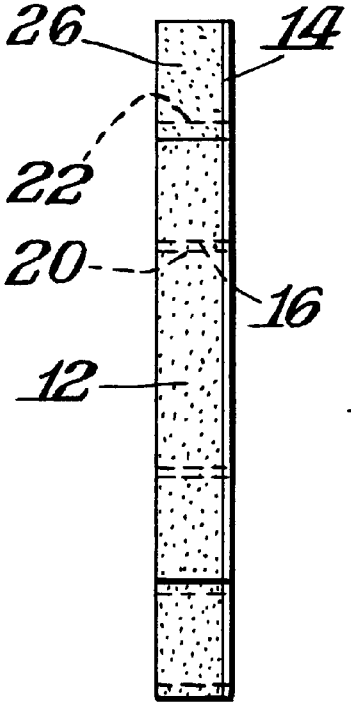
FIG. 2 is a left side elevational view of the hinged packaging support element of FIG. 1.
Figure 1:
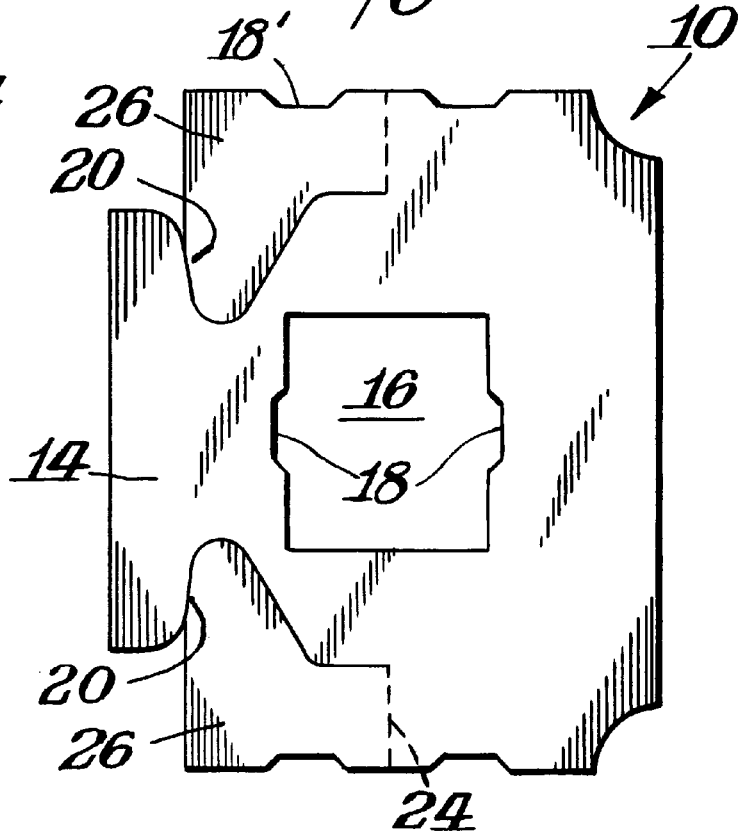
FIG. 1 is a top plan view of a hinged packaging support element with a foldable retaining arm.
Figure 3:
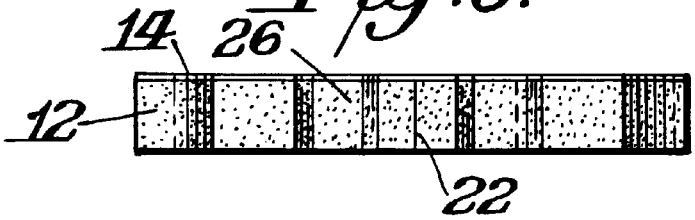
FIG. 3 is a front elevational view of the hinged packaging support element of FIG. 1.
Figure 4:
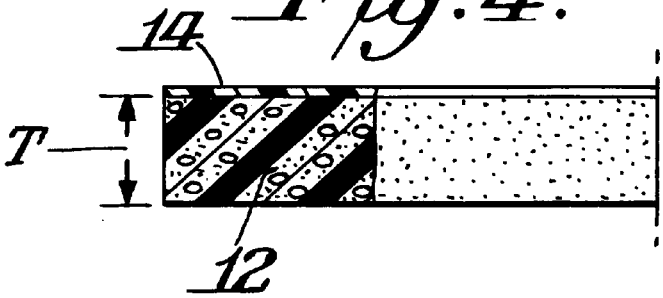
FIG. 4 is an enlarged fragmental view partially in section showing the laminate construction of the hinged packaging support element.

As shown in FIG. 1, a central portion of the packing element has been removed to leave an opening 16 into which a fragile article may be held. Relief notches 18 are formed at the sides of the opening for greater ease when inserting an article into this opening 16. Relief notches 18' are also provided along the outer edges of the packing element to make it easier to insert and remove the element into and out of a shipping carton.

The flexible polyurethane foam preferably has a density in the range of about 0.7 lbs/ft$^3$ to about 2.8 lbs/ft$^3$, and an $IFD_{25}$ in the range of about 25 lbs to about 270 lbs. The foam may be provided with a desired thickness for the specific packaging application. Thicknesses from one to four inches have been found suitable for most applications. While it is preferred to use a flexible polyurethane foam sheet with a uniform thickness for ease in handling and storage, sheets with varying thickness may be used to form packing elements according to the invention.

The film preferably is polyethylene film having a thickness in the range of about 2 mil to about 125 mil, preferably about 2.5 to about 5 mil. Alternative film materials may be used, such as polypropylene and urethane, polyvinyl chloride (PVC), polyester, polybutadiene, polyamid, polyvinylacetate, polycarbonate and copolymers thereof. The film is adhered to the flexible foam sheet using one of the methods known to those of skill in the art, such as flame lamination, spray adhesive, hot melt adhesive, or heating to soften the film combined with compression (i.e., hot roll laminating). The film should be well bonded to the entire foam surface. Bonding strengths of about 2 lb/in are preferred. Films with an ultimate tensile strength of 1500 psi (measured for 0.002 inch thick film) are acceptable, although preferably the films have ultimate tensile strengths of above 2000 psi. Polyethylene films, such as Dow Chemical INTEGRAL 933 adhesive film, work well. Superior Nonwovens of Grey Court, SC offers a polyester web under the trademark CEREX that also may be used.

As an alternative to films from plastic materials, such as polyethylene films, foamed plastic may be applied as the "film" in the present invention. A foamed polyethylene sheet (6 pcf) cut to ⅛" thick from Dow Chemical has been used as the "film" applied to the foam.

After they are laminated together, the foam 12 and film 14 both may be cut using known cutting methods, such as die cutting or hot wire cutting or sawing. Cut lines 20 are shown where the foam and film have been cut along a straight and curved pattern.

Using a die cutting method known as "kiss-cutting", a portion of the foam is cut or sliced along a cutting line 22 while the film directly adjacent the cut foam is not cut or sliced. The cut surfaces of the foam at the cutting line 22 may then be separated apart, causing a bending of the uncut film. The portion of uncut film forms a repeatedly bendable hinge 24. Retainer arm 26 is thus formed in the packing element 10.

Figure 5:
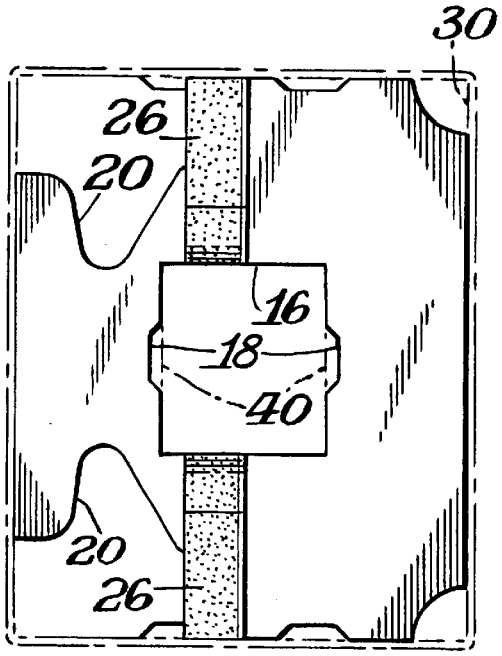
FIG. 5 is a top plan view of the hinged packaging support element positioned within a shipping carton and having its foldable retaining arms folded upwards and engaging the sides of a representative article to be packaged and shipped within the shipping carton.
Figure 6:
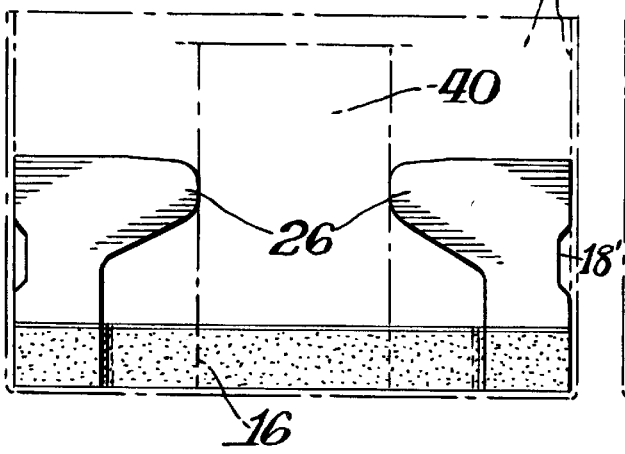
FIG. 6 is a left side elevational view of the packaging support element positioned within the shipping carton of FIG. 5, wherein the article to be packaged and shipped is shown in phantom outline.
Figure 7:
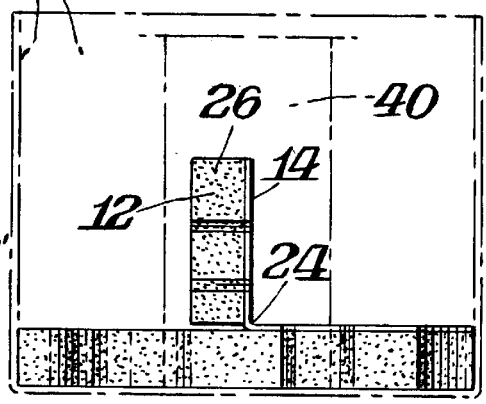
FIG. 7 is a front elevational view of the hinged packaging support element positioned within the shipping carton of FIG. 5.

Referring next to FIGS. 5–7, the packing element 10 is installed within a carton 30. A fragile article 40 is held within the opening 16 in the packing element 10. The packing element 10 contacts the bottom and side walls of the carton 30. The cut surfaces of the foam are separated apart to cause the uncut film to bend at the hinge 24. Retaining arms 26 are bent at the hinges 24 and stand upright. The arms 26 so positioned contact the sides of the article and the sides of the carton to hold the article 40 in place within the carton 30. The hinge 24 is repeatably bendable such that the retaining arms may be positioned perpendicularly to the top planar surface of the packing element, or flush with that top planar surface, or at any angle therebetween. If necessary, the hinge may be bent at angles even greater than 90 degrees.

EXAMPLES

Foams: Commercially, using a continuous pouring process known in the art, the foam ingredients were mixed together and poured onto a moving conveyor. Foam formulation A was made using a controlled pressure chamber operating under vacuum. The pressure was maintained below atmospheric pressure by pumping air out of the chamber. Using a pressure regulator, the pressure was maintained at the operating pressure while the foam was allowed to rise. Foam formulation B was made at atmospheric pressure, and pressure control was not necessary.

The polyols were obtained from the following suppliers: VORANOL 3010,3943 and 4001 from Dow Chemical. The surfactants NIAX L618 and L620 were obtained from CK Witco. The amine catalyst ZF53, the tin catalyst K-29 and the stabilizer DEA-LFG-85 were from Huntsman. The R7400 isocyanate was from Huntsman. The TDI 80/20 isocyanate was from Dow Chemical. Foam formulation A produced a foam with a density of 1 lbs/ft$^3$ and an $IFD_{25}$ of 75 lb. Foam formulation B produced a foam with a density of 1.4 lbs/ft$^3$ and an $IFD_{25}$ of 75 lb.

Drop curves were developed for each material using the test method of ASTM 1596. Air permeability was determined in cubic feet per square foot per minute for each sample using a Frazier Differential Pressure Air Permeability Pressure Machine in accord with ASTM 737. $IFD_{25}$ or "indentation force deflection" was determined in accord with ASTM D3574.

The foam was cut to form a block or sheet with desired thickness. Films from 2 to 5 mil of Dow Chemical INTEGRAL 933 adhesive film, supplied with a hot melt adhesive, were applied to the cut top surface of the sheets using a Black Brother Hot Oil laminator. Alternately, a spray adhesive such as 3M Super 77 Spray Adhesive was used.

TABLE 1

| | Formulation | A | B |
|---|---|---|---|
| Polyol | V-3943 | 80 | 80 |
| | V-3010 | 0 | 20 |
| | V-4001 | 20 | 0 |
| Surfactant | L618 | 1 | 0 |
| | L620 | 0 | 0.8 |
| Amine | ZF53 | 0.3 | 0.25 |
| Tin Catalyst | K-29 | 0.2 | 0.25 |
| Stabilizer | DEA-LFG-85 | 0.3 | 0 |
| Water | | 5 | 4.5 |
| Isocyanate | R7400 | 84.6 | 0 |
| | TDI 80/20 | 9.4 | 59.0 |
| Index | | 102 | 113 |
| Chamber Pressure | (mbar) | 650 | 1000 |
| Density | (pcf) | 1.0 | 1.4 |
| $IFD_{25}$ | (lb) | 75 | 75 |
| ½" permeability | | 42 | 170 |

Amounts were parts by weight based on 100 parts polyol.

To test the tear strength of the hinge, the ASTM 3574 test was modified by cutting the sample specimen to 2 inches long, such that the tear would propagate toward the film on the laminated surface. With a standard ASTM 3574 tear strength test, the sample is not torn to the end and the tear angle is specified as different from 90 degrees. We found that the tear strength dropped by about 30 to 40% toward the end of the tear. In other words, as the tear angle exceeds 90 degrees, the stress concentrates and in effect reduces the foam's tear strength. Given that the foam often will be bent to greater than 90 degrees in the hinge design, the tear strength reduction at the hinge highlighted the benefits of a local reinforcement. Thus, although unreinforced flexible polyurethane foams already are believed to have greater resistance to tearing and cracking than rigid polyurethane foams, the hinge provides added benefits.

Figure 8:
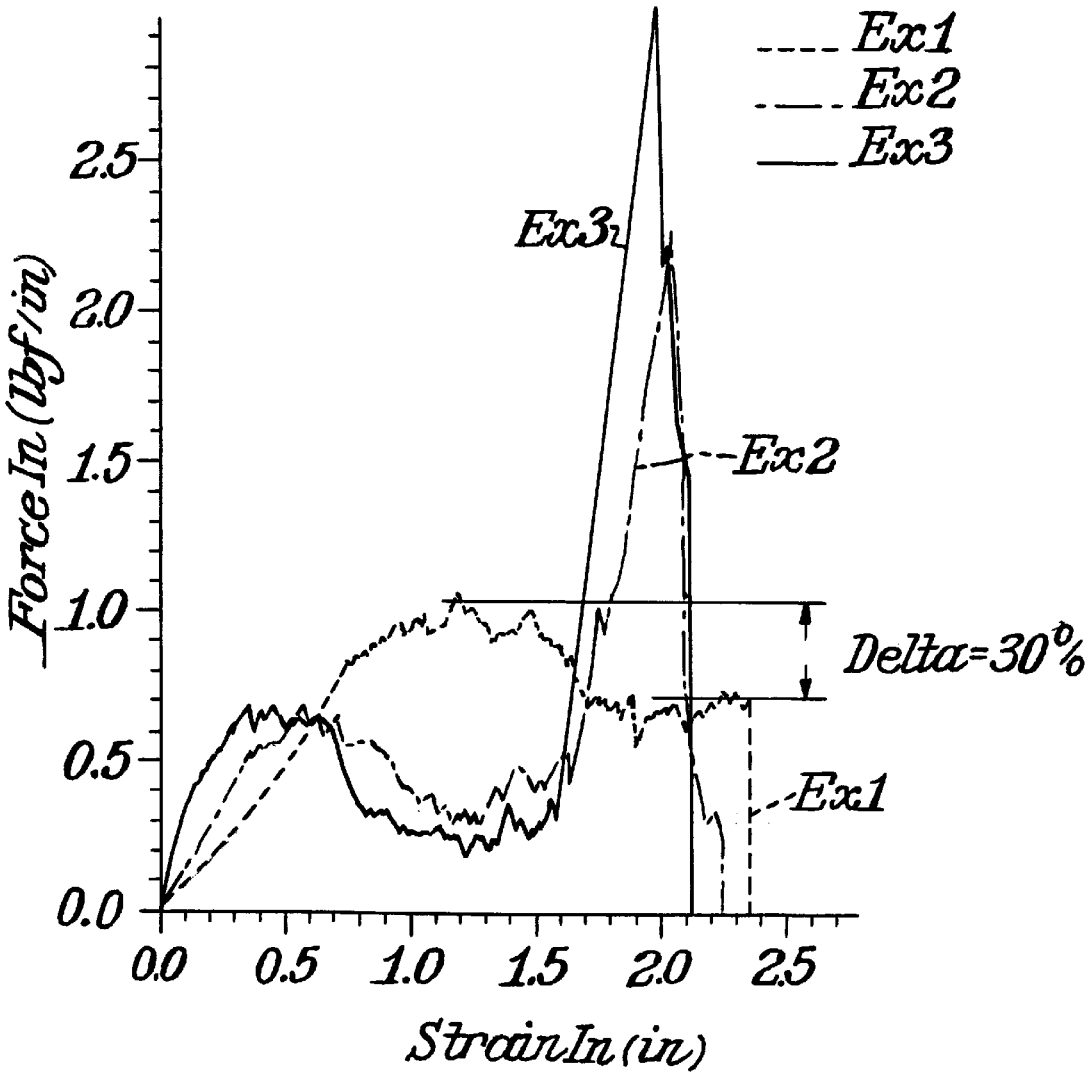
FIG. 8 is a force-strain curve obtained during tear strength measurements on various hinged flexible polyurethane foam protective packing elements.

TABLE 2 below shows various combinations of foam, laminate and adhesive tested. Examples 1 to 8 were made with foam formulation A, whereas examples 9 to 11 were made with foam formulation B. As shown in FIG. 8, the tear strength of the foam for foam formulation A was 1.0 lb/in per ASTM 3574. However, at the hinge, due to stress concentration, the tear strength dropped to 0.72 lb/in. In examples 2 to 6, the film-foam laminate had improved tear strength of 2.2 to 3.0 lb/in with the hot melt adhesive and 3.8 to 4.2 lb/in with the spray adhesive. In these examples, after the foam structure broke apart, debonding of the film from the foam surface occurred. The plastic film never experienced tensile failure, and the tear strength for the hinge depended primarily upon the adhesive bond strength. For the examples, when applying the spray adhesive to form the hinged laminate structure, both the foam and film were sprayed. This formed a stronger bond.

In example 7, a CEREX polyester film was applied to the foam. In this example, the CEREX film broke, and no debonding of the film from the foam was observed. Since the CEREX film had a lower tear strength, the crack propagated along that film. In example 8, a 125 mil, 6-pcf polyethylene foam (a foamed "film") was adhered to the foam, and the tear strength of the hinge was improved to 4.3 lb/in.

After bending each hinge for 30 cycles, the control example 1 (without a film) developed a ½" crack in the 1" wide hinge and could not maintain the intended hinge pack shape. In comparison, examples 2, 6 and 8 did not show any fatigue and consistently maintained the intended hinge pack shape.

In examples 9 to 11, the observations were similar. The plastic laminate improved the tear strength for the hinge from 0.8 to 2.5–4.0 lb/in. These data demonstrate the benefits of laminating a film to foam to form a hinge and thereby reinforce the tear strength and improve the rigidity and stability of both the hinged portions and the laminated foam surface.

TABLE 2

| Example | 1 | 2 | 3 | 4 | 5 | 6 | 7 | 8 | 9 | 10 | 11 |
|---|---|---|---|---|---|---|---|---|---|---|---|
| Foam | A | A | A | A | A | A | A | A | B | B | B |
| Film | None | 2 mil PE | 4 mil PE | 5 mil PE | 4 mil PE | 5 mil PE | CEREX | 125 mil 6-pcf PE foam | None | 2 mil PE | 4 mil PE |
| Adhesive | None | hot melt | hot melt | hot melt | spray | spray | spray | spray | None | hot melt | hot melt |
| Tear strength (lb/in) | 0.72 | 2.17 | 2.95 | 2.76 | 3.80 | 4.19 | 1.80 | 4.26 | 0.75 | 2.52 | 4.05 |
| Integrity after 30 cycles | Poor | Good | Good | Good | Good | Good | Good | Good | Poor | Good | Good |

Figure 9:
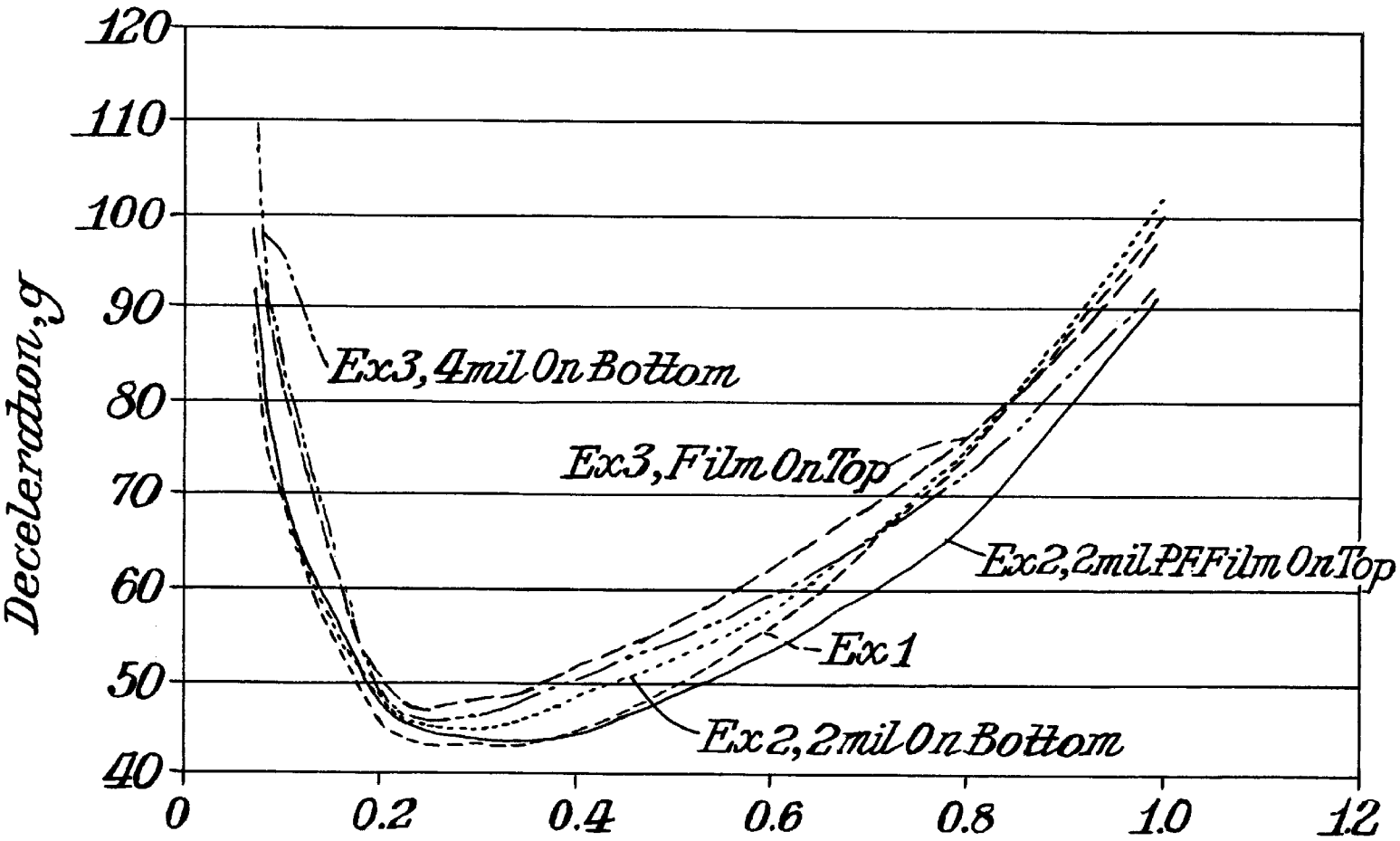
FIG. 9 is a graph of deceleration versus static stress ("drop curve") for various hinged flexible polyurethane foam protective packing elements.

Drop curves in FIG. 9 show no adverse effect from forming the hinge, whether the laminate film was on the top or on the bottom of the foam packing element structure. The foam packing elements had a cushion thickness of two inches and the drop height was 24 inches. The foam of example 2 was tested with a 2 mil PE film applied to its top surface or to its bottom surface, respectively. The foam of example 3 was tested with a 4 mil PE film applied to its top surface or to its bottom surface, respectively. The foam of example 1 had no film attached. The drop curves for hinged packing elements formed with flexible polyurethane foams show deceleration versus static stress values with best applicability for packaging fragile articles with lower mass.

Figure 10:
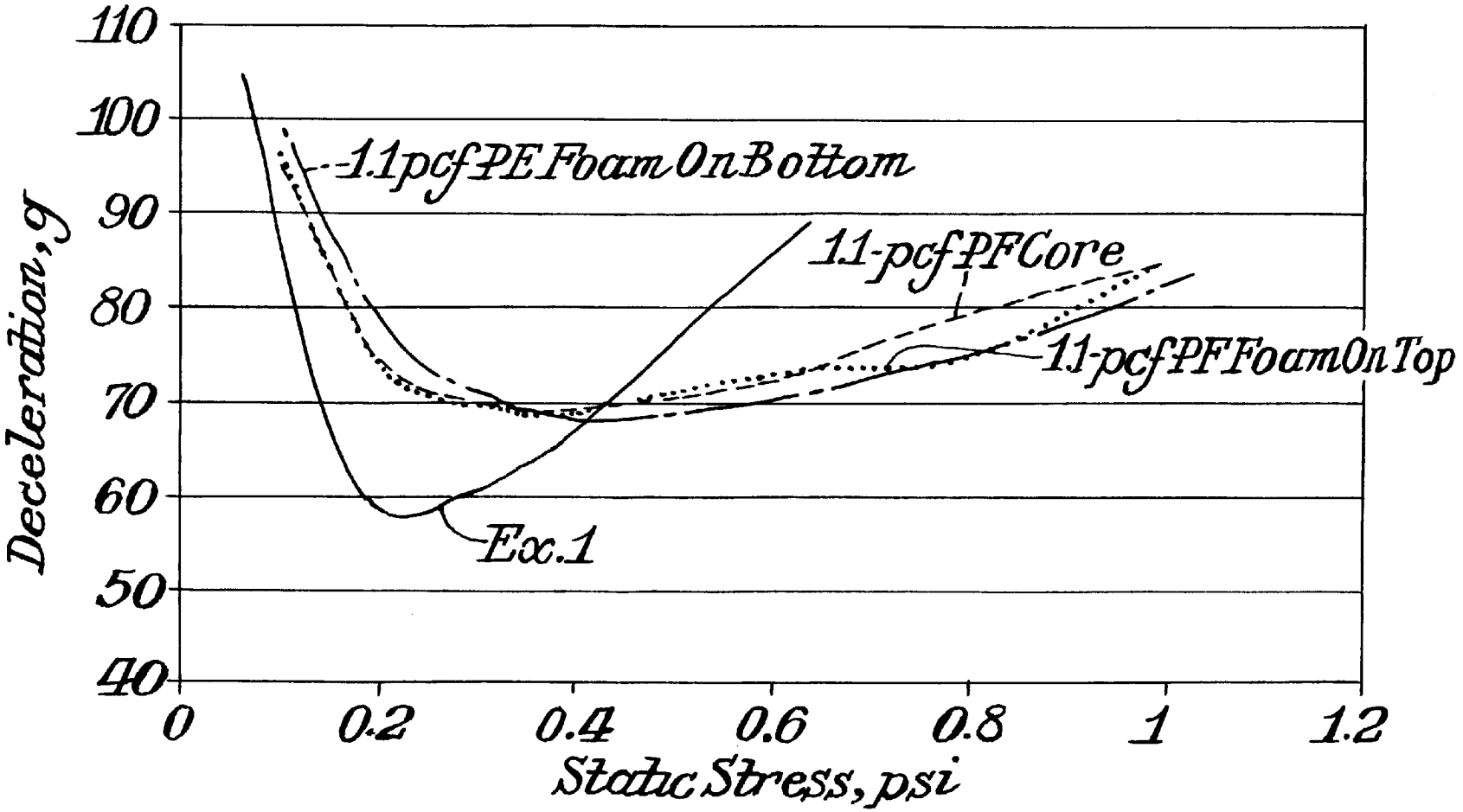
FIG. 10 is a graph of deceleration versus static stress ("drop curve") for various flexible and rigid foam elements.

As shown in FIG. 10, a drop curve for flexible polyurethane foams (such as Example 1) are compared with drop curves for rigid polyethylene foams. The rigid polyethylene foam packaging elements were obtained from Sentinel Corporation. The foam packing elements had a cushion thickness of 1.5 inches and the drop height was 24 inches. The foam of Example 1 was compared with an example packing element of rigid PE foam laminated on the bottom surface with a foamed "film" of ⅛" 6 pcf polyethylene. Another example tested had rigid PE foam laminated on the top surface with a foamed "film" of ⅛" 6 pcf polyethylene. The last example in FIG. 10 was rigid PE foam without any film laminated to its surface(s). When fragile articles are shipped in shipping cartons, the static stresses are generally lower. Flexible polyurethane foam packaging elements are preferred for use with fragile articles due to their better dynamic cushioning characteristics, as demonstrated for example in the drop curves in FIG. 10.

The invention has been illustrated by detailed description and examples of the preferred embodiments. Various changes in form and detail will be within the skill of persons skilled in the art. Therefore, the invention must be measured by the claims and not by the description of the examples or the preferred embodiments.

We claim:

1. A protective packing element for use in packaging and shipping cartons, consisting essentially of:

a sheet of flexible polyurethane foam having an outer surface and a thickness, wherein the foam has a $IFD_{25}$ less than about 270 lbs/ft$^3$; and a film adhered to the outer surface of the flexible polyurethane foam;

wherein said flexible polyurethane foam sheet defines a cut portion through a substantial portion of the thickness of the sheet, which cut portion does not extend through the film, so that a repeatably bendable hinge is formed by the film at a portion of the film adjacent the cut portion of the flexible polyurethane foam sheet.

2. The protective packing element of claim 1, wherein the flexible polyurethane foam has a density in the range of about 0.7 lbs/ft$^3$ to about 2.8 lbs/ft$^3$.

3. The protective packing element of claim 1, wherein the flexible polyurethane foam has an $IFD_{25}$ in the range of about 25 lbs/ft$^3$ to 270 lbs/ft$^3$.

4. The protective packing element of claim 1, wherein the film is formed from a material selected from the group consisting of: polyethylene, polypropylene, urethane, polyvinyl chloride (PVC), polyester, polybutadiene, polyamid, polyvinylacetate, polycarbonate and copolymers thereof.

5. The protective packing element of claim 1, wherein the film is formed from a foamed plastic.

6. The protective packing element of claim 1, wherein the film has a thickness in the range of from about 2 mil to about 125 mil.

7. The protective packing element of claim 1, wherein the repeatably bendable hinge withstands more than 30 bending cycles without substantial observable tearing of the film.

* * * * *